United States Patent [19]

Green et al.

[11] Patent Number: 4,993,515

[45] Date of Patent: Feb. 19, 1991

[54] POLE CLIMBER ASSEMBLY

[76] Inventors: Bruce G. Green; Richard G. Green, both of 9604 111th Ave., SE., Kirland, Wash. 98033

[21] Appl. No.: 328,290

[22] Filed: Mar. 24, 1989

[51] Int. Cl.[5] ..... A63B 27/02

[52] U.S. Cl. ..... 182/221; 182/134

[58] Field of Search ..... 182/221, 133–136

[56] References Cited

U.S. PATENT DOCUMENTS

| | | | |
|---|---|---|---|
| 1,243,436 | 10/1917 | Marshall | 182/221 |
| 1,867,894 | 7/1932 | Rush | 182/221 |
| 2,262,394 | 11/1941 | Evans | 182/221 |
| 2,570,001 | 10/1951 | McCammond | 182/221 |
| 2,607,522 | 8/1952 | Bennington | 182/221 |
| 3,297,105 | 1/1967 | Lawrence | 182/221 |
| 3,867,998 | 2/1975 | Joseph | 182/221 |
| 4,530,420 | 7/1985 | Hobbs | 182/221 |

*Primary Examiner*—Reinaldo P. Machado

*Attorney, Agent, or Firm*—Russell W. Illich

[57] ABSTRACT

A pole climber assembly that helps prevent the user from being electrocuted by contact of any part of the assembly with an electrical source. The assembly includes a hook or stirrup which is molded of a nonconductive composite material. The composite material has the strength of a stell stirrup. Other features of the assembly include calf pads and straps that may be made of nylon, a non-skid thermoplastic pad on the exterior side of the stirrup to prevent wear of the composite material resulting from walking use, and an adjustable section allowing the pole climber to be adapted to users of any height.

12 Claims, 6 Drawing Sheets

Fig. 3a
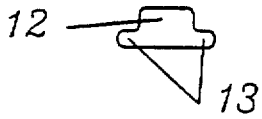
Fig. 2
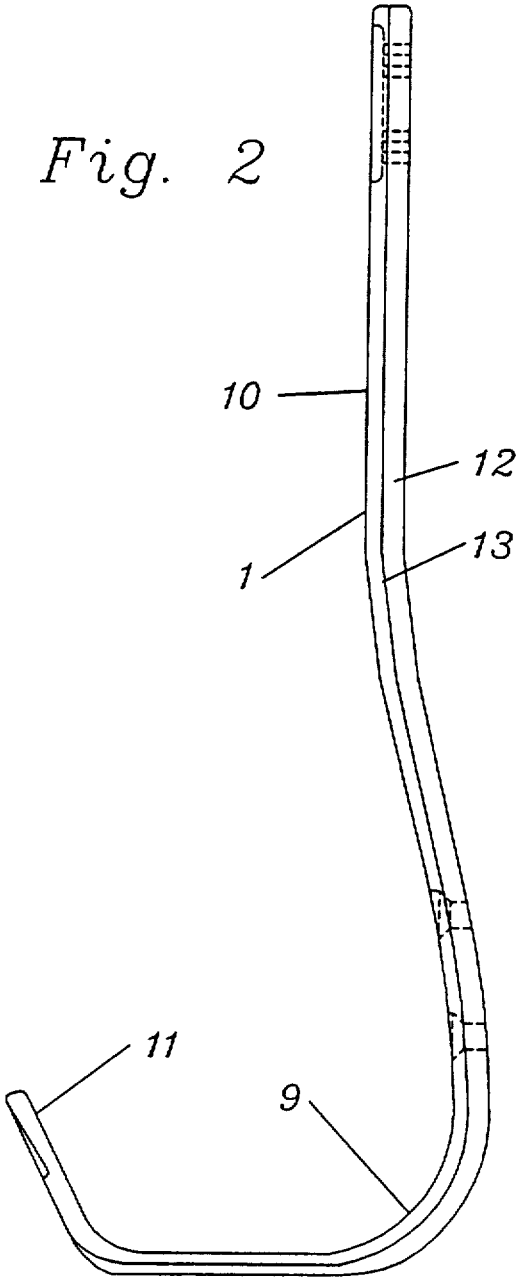
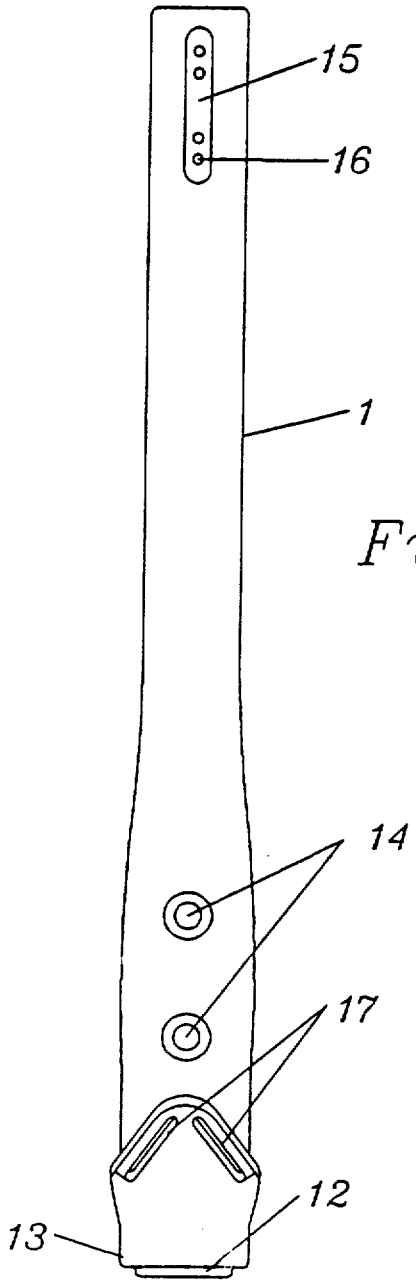
Fig. 3

POLE CLIMBER ASSEMBLY

BACKGROUND OF THE INVENTION

The present invention relates to vertical pole or tree climbers that are commonly used by utility workers and loggers. These climbers generally comprise hooks that form stirrups that extend up the side of one's legs and include a pointed spur or gaff to allow the person to climb up vertical wooden poles and trees. The climbers are generally strapped to the persons calf and foot by a pair of straps. A major problem that has remained unsolved in the use of these climbers is their inherent conductivity due to the metal used within the hooks and straps. If a gaff penetrates an insulated electrical line or the hook or strap buckle comes into contact with a bare electrical line, the pole climber automatically conducts the electricity to the worker's leg causing electrical shock and possible injury.

There has been several attempts to solve this problem with redesigned pole climbers. The U.S. Pat. Nos. 1,867,894 to Rush and 1,243,436 to Marshall use a metal hook that is encased by insulating rubber. This design has several disadvantages. One problem is rubber tends to be susceptible to wear which may lead to a short lifespan of these pole climbers which would not be very economical. Another problem is that the rubber covers the spur which makes the entire climber assembly useless once the spur is worn out while traditional climbers have replaceable spurs. Furthermore, generally the dialectric strength of rubber is low relative to other types of materials such as composite resin impregnated materials.

The U.S. Pat. No. 3,297,105 to Lawrence shows a resin impregnated fiberglass stirrup that is rigidly secured to a metal hook and spur. The problem with this design is that the fiberglass skin is only a partial covering of the steel structural section which can still conduct electricity. Also, if the climbers are exposed to a high enough current, the voltage can arc through the fiberglass or conduct through the spur and electrocute the user. Additionally, the fiberglass skin adds many more costly steps to the construction process of the hooks, and the bonding of the fiberglass skin to the metal can be questionable as a safety aspect of the design due to the incompatibility of the two materials. The pole climber designs noted above fail in their attempt to resolve the problem of preventing electrocution of a person using pole climbers.

SUMMARY OF THE INVENTION

It is an object of this invention to provide a pole climber assembly that insulates the user's leg from electrical shock due to contact of the assembly with an electrical source.

Another object of the invention is to provide such a non-conductive pole climber assembly with the needed strength characteristics of the ASTM standards for personal climbing equipment.

It is a further object of the invention to provide a pole climber assembly that is more functional than traditional climbers by including such features as lighter weight, bright coloring, adjustability, and more comfort.

Other objects of the invention will be apparent hereinafter from the specification and from a recital of the appended claims, particularly when read in conjunction with the accompany drawings.

The present invention comprises a pole climber assembly made entirely of high conductivity resistant materials with the exception of a metal gaff or spur and fasteners. This gaff is suitably insulated from the leg as not to be a problem in conducting electricity to the leg. The assembly comprises a hook or stirrup that is made entirely of a non-conductive composite material such as fiberglass, aramid fibers such as Kevlar, and resin systems such as epoxy, polyester, or vinylester. The development of such composite materials in recent years allow the pole climbers of the present invention to have all of the ASTM strength requirements and still remain non-conductive. The pole climber assembly also includes a calf pad that may be formed of closed cell foam padding within an exterior thermoplastic exterior shell such as nylon fabric. The strapping may be made of polyester and/or nylon webbing with thermoplastic snap fit buckles. Other aspects of the assembly include non-skid thermoplastic pads attached to the bottom of the stirrups or hooks should the hooks be walked in while on level ground, and an adjustment section may conform to the hook and allow the assembly to be adjusted to a wide variety of lengths for persons of any height.

BRIEF DESCRIPTION OF THE DRAWINGS

FIG. 2 shows a side plan view of the hook used in the pole climber assembly of FIG. 1.

FIG. 3 shows a front plan view of the hook shown in FIG. 2.

FIG. 3*a* shows a top plan view of the hook shown in FIG. 2.

DETAILED DESCRIPTION OF THE INVENTION

Figure 1:
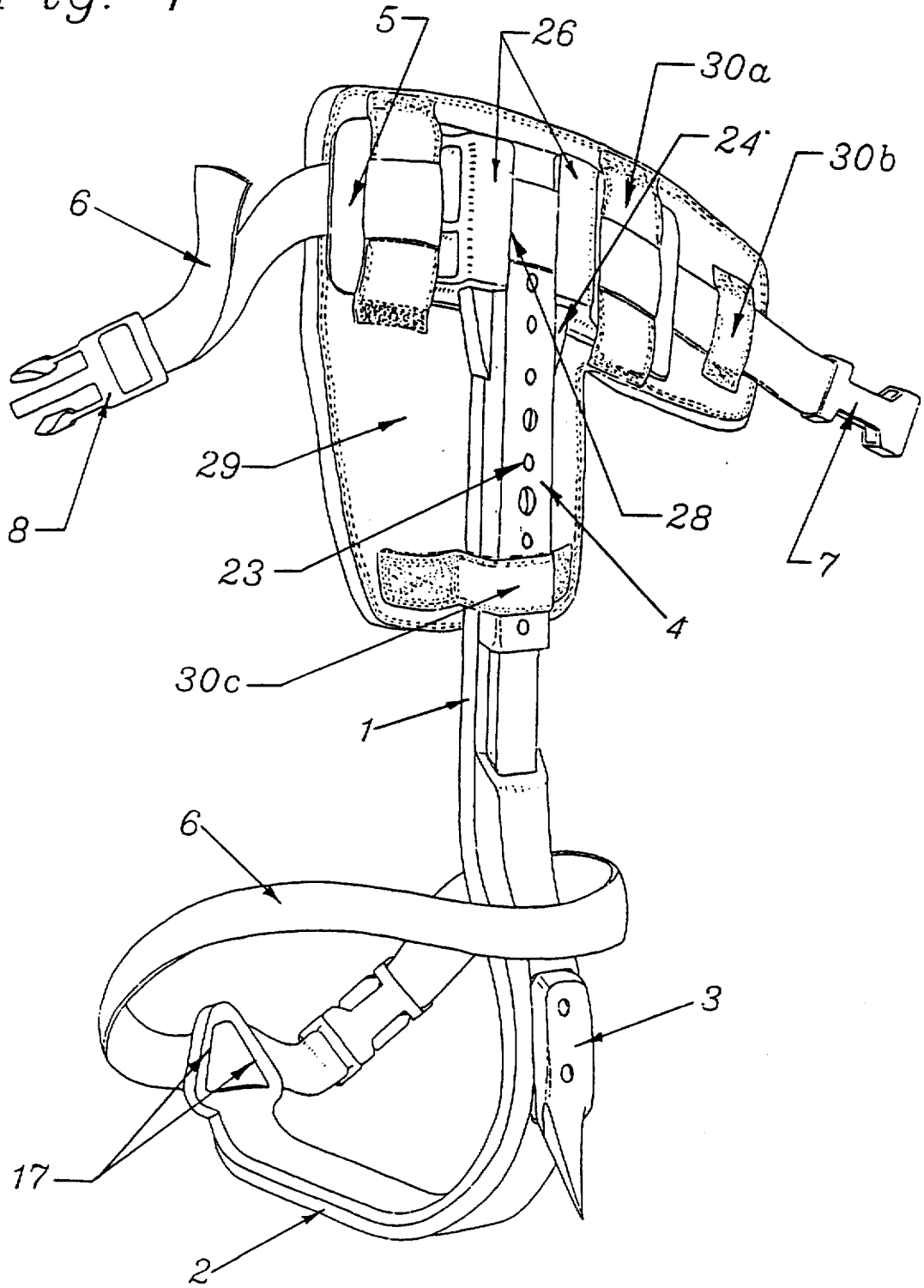
FIG. 1 shows a perspective view of the preferred embodiment of the pole climber assembly.

FIG. 1 shows the pole climber assembly of the present invention. The entire assembly is made of materials that are highly resistant to conductivity and have high dialectric strengths (hereinafter referred to as "non-conductive") with the exception of the gaff 3. However, the gaff is suitably insulated from the person's leg by not coming into contact with the user's leg.

The main parts of the pole climber assembly include a hook 1 and a non-skid pad 2 attached to the bottom of the hook to protect the hook 1 from structural damage during use resulting from contact with objects on the ground, pole, or other gaffs. An adjustment section 4 is attached to the hook to allow the pole climbers to be adapted for persons of different height. A pad attachment section 5 is attached to the top of the adjustment section to give added support to a person's leg when the pole climbers are strapped onto the leg, and the pad attachement section provides a mounting means for a calf pad 29 which further cushions and insulates the person's leg. Finally, straps 6 are used to strap a person's leg into the pole climbers. There are two straps, one for wrapping around a person's ankle and another for wrapping around a person's calf. The straps 6 have female and male buckles at their ends which lock together and provide a means of tightening the straps across the leg.

FIGS. 2 and 3 show the details of hook 1 used in the pole climber assembly. The hook is formed entirely of a non-conductive composite material and molded as a one piece unit. The hook includes a calf section 10 that runs parallel to a person's calf when strapped into the climbers, a stirrup section 9 which holds a person's foot in place within the climbers and runs perpendicular to the calf section, and a strap attachment section 11 at the bottom tip of the hook for providing a means for attaching a tightening strap across the foot. The cross sectional shape of the hook 1 is a t-shape which can be best viewed in FIG. 3*a* where a center section 12 has a pair of flanges 13 extending outwardly from opposite sides of the center section. The t-shaped cross section gives the hook added stiffness as well as providing a molded mounting means for other parts of the pole climber assembly such as the non-skid pad 4 and adjustment section 5.

Other molded features within the hook 1 include countersunk holes 14 which house the fasteners used to attach the gaff 3 to the hook. At the upper end of the calf section 10 is shown a recess 15 and fastener holes 16 which provide a mounting means for the adjustment section. The recess provides a housing for a pair of standard nuts (not shown) which are threadably connected to a pair of bolts (also not shown) which extend through two of the fastener holes to attach the adjustment section to the hook, which will be explained in more detail later in the specification. The recess 15 and countersunk holes 14 provide a means to hide the fasteners below the interior surface of the hook. This hiding means constitutes a part of the insulation feature of the hook which insulates the lower leg from electrical shock. At the end of the hook within the strap attachment section are a pair of strap slots 17. As can be seen in FIGS. 2 and 3 the strap slots 17 are angled with respect to each other and the entire strap attachment section 11 is angled upward from the adjoining stirrup section 9. These angled features are to ensure that the strap 6 which is threaded through the slots 17 is angled upward toward the calf section 10 so that the strap may be secured fastened about the hook. The orientation of the strap 6 relative to the hook can be best seen in FIG. 1.

Figure 4:
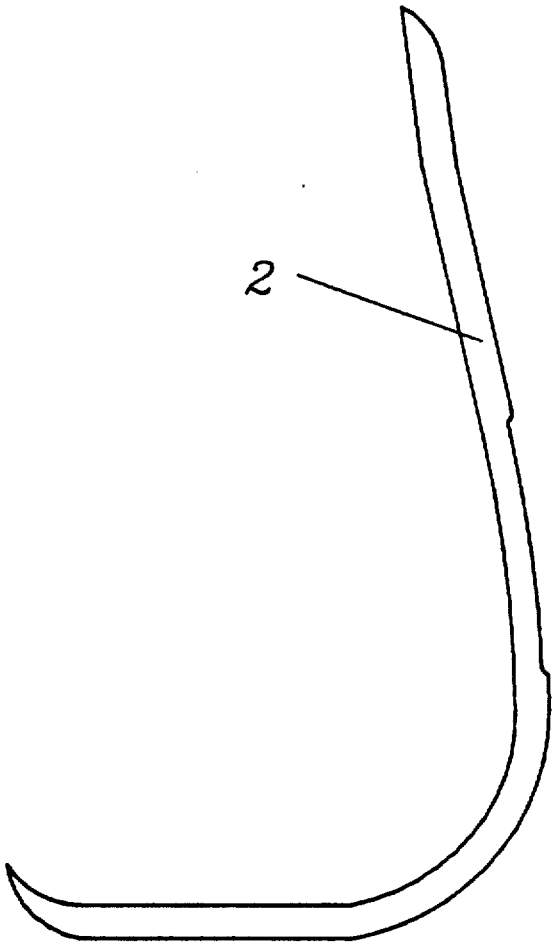
FIG. 4 shows a side plan view of the non-skid pad used in the pole climber assembly of FIG. 1.
Figure 5:
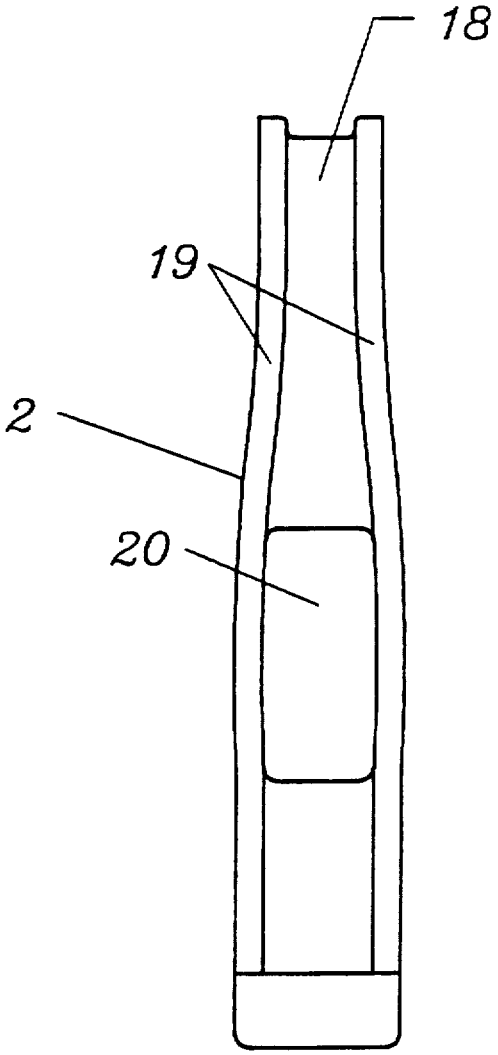
FIG. 5 shows a front plan view of the non-skid pad shown in FIG. 4.

FIGS. 4 and 5 show side and front plan views of the non-skid pad 2, respectively. The skid pad is made of a thermoplastic material that is designed to protect the hook 1 from structural damage during use resulting from contact with objects on the ground, pole, or other gaffs. The non-skid pad also serves an additional purpose when the thermoplastic material of the pad 2 begins to wear on the outside of the pad. The non-skid pad then acts as a wear indication device as to how long the pole climber assembly has been in use. This latter feature is very useful for users of the climbers that periodically replace pole climbers for safety reasons. As can be seen in FIG. 5 the non-skid pad is u-shaped with a center section 18 and a pair of opposed flanges 19 which lie substantially normal to the center section. This shape allows the skid-pad to conform to the t-shaped cross section of the hook 1. The fit of the pad 2 relative to the hook 1 can best be seen in FIG. 1. The non-skid pad is bonded directly to the hook in the manufacturing process of the hook 1 or can be bonded to the hook 1 during a secondary fabrication process. The pad also has a provision for the gaff 3 which is directly attached to the hook by threaded fasteners. This provision for the gaff comes in the embodiment of a rectangular opening 20 within the center section 18 of the non-skid pad 2.

Figures 6, 7, 8, 9:
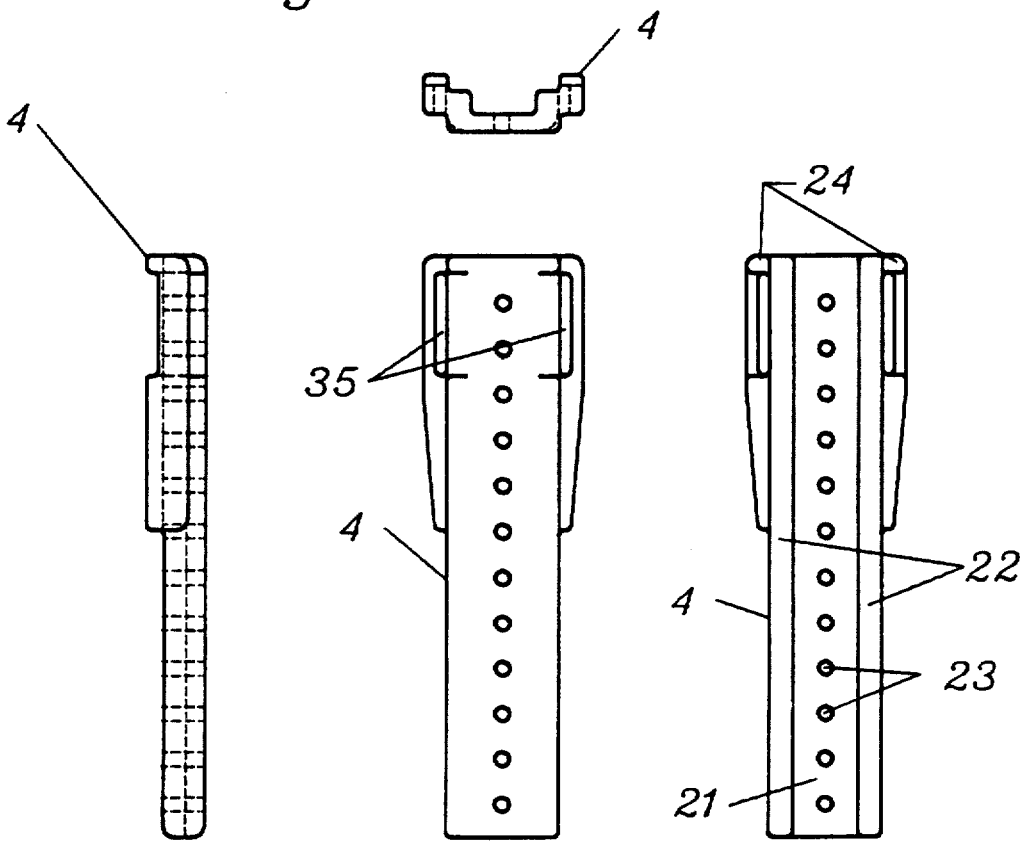
FIG. 6 shows a front plan view of the adjustment section used in the pole climber assembly of FIG. 1.
FIG. 7 shows a rear plan view of the adjustment section of FIG. 6
FIG. 8 shows a top plan view of the adjustment section of FIG. 6.
FIG. 9 shows a side plan view of the adjustment section of FIG. 6.

FIGS. 6–9 show the various plan views of the adjustment section 4. The adjustment section is u-shaped in cross section with a center section 21 and a pair of normal flanges 22 to fit across the t-shaped hook 1 as the non-skid pad does. The adjustment section is also made of a non-conductive composite material, also, and has a number of molded features thereon. The first feature is a series of adjustment holes 23 which align with fastener holes 16 of the hook. Two threaded bolts (not shown) are inserted through two of the adjustment holes from the back side of the adjustment section 4 as seen in FIG. 7. The bolts are then threaded into two nuts (not shown) on the opposite or interior side of the hook 1 to fasten the adjustment section securely to the hook. The number of holes 23 allow for adjustments of ¼" increments from 14 ¾" to 21" as called for in the ASTM specifications. Also shown in FIGS. 6 and 7 are two additional flanges 24 which include longitudinal strap slots 35. The function of the flanges 24 and slots 35 is to mount the calf pad 29, pad attachment section 26, and another strap 6 as will be explained below.

Figure 10:
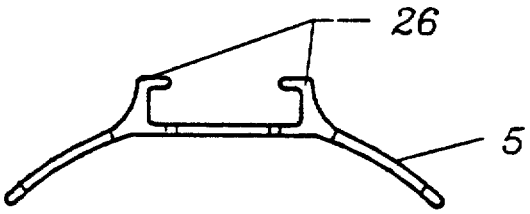
FIG. 10 showns a top plan view of the pad attachment section used in the pole climber assembly of FIG. 1.
Figure 11:
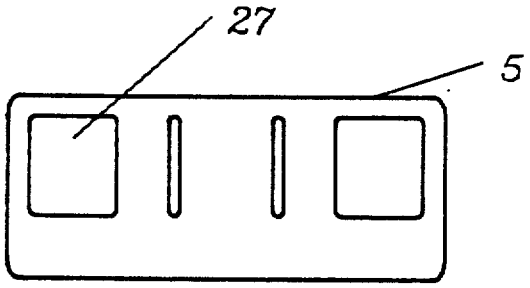
FIG. 11 shows a front plan view of the pad attachment section shown in FIG. 10.
Figure 12:
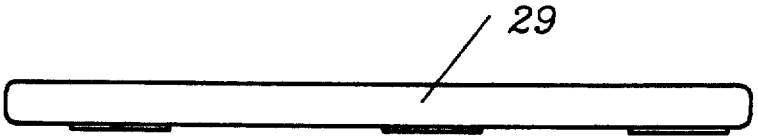
FIG. 12 shows a top plan view of the calf pad used in the pole climber assembly of FIG. 1.
Figure 13:
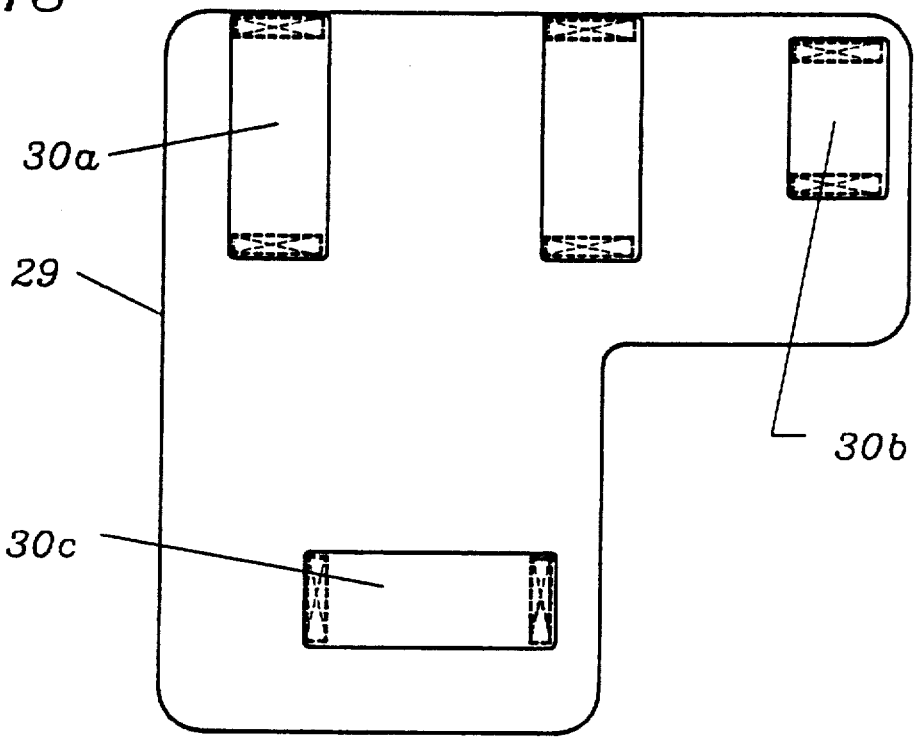
FIG. 13 shows a rear plan view of the calf pad of FIG. 12.

FIGS. 10 and 11 show the pad attachment section 5 which is mounted on the adjustment section by right angled flanges 26. These flanges 26 conform to the flanges 24 of the adjustment section so that the pad attachment section is closely fitted with the adjustment section. The pad attachement section 5 is also made of a thermoplastic material which is non conductive and semi-rigid. It is molded to conform to a user's calf through curved pad supports, but is is flexible enough to fit most any calf, large or small. The calf pad 29 is shown in FIGS. 12 and 13 and is made of a closed cell foam padding construction with a outer nylon shell. The calf pad 29 includes pad attachment section supports 30*a*, a strap support 30*b* and an adjustment section support 30*c*. These supports can be made of the same material as straps 6 and can be stitched onto the pad 29 as shown in FIG. 13.

The attachment of the calf pad 29 and pad attachment section 5 to the hook 1 can best be viewed in FIG. 1 in conjunction with FIGS. 10 and 11. First, the pad 29 is fitted over the pad supports such that supports 30a lie over openings 27 within the pad supports. Second, the pad attachment section 5 slides down over the adjustment section 4. This attachment is guided by flanges 26 of the pad attachment section mating with flanges 24 of the adjustment section and support 30c fitting over the adjustment section 4. A pair of slots 28 within the pad attachment section are aligned with slots 35 of the adjustment section. Finally the strap 6 rigidly secures the calf pad 29, pad attachment section 5, and adjustment section 4 together. This is done by threading the strap through the strap support 30b, through opening 27, over support 30a, back through opening 27, through the two pairs of aligned slots 28, 35, back through opening 27, and finally around another support 30a. The male end buckle 8 is then secured to the end of the strap 6. The strap 6 is then secured about the calf of a person using the climbers by buckling both buckle ends 7 and 8 and subsequently tightening the strap 6. This pad attachment design allows for the use of non-conductive materials such as plastic supports, nylon straps and pads, nylon thread, and acetal snap fit buckles instead of the leather pads with metal rivets and metal buckles that are commonly used and which do conduct electricity.

Figure 14:
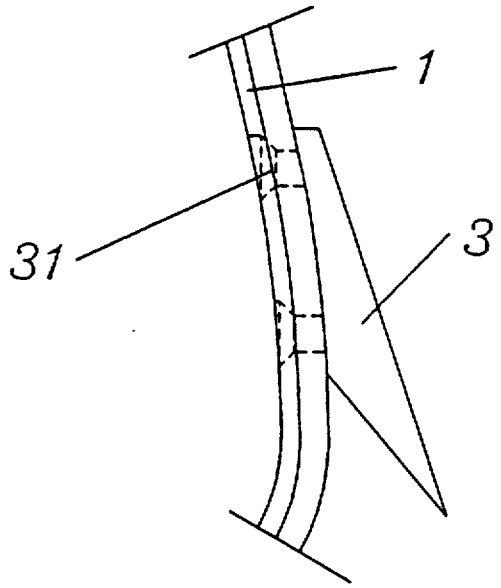
FIG. 14 shows a partial side plan view of the hook and gaff used in the pole climber assembly of FIG. 1.

FIG. 14 shows the attachment of the gaff 3 to the hook 1. The gaff is provided with a projection which resides in a recess within the inside of the hook 1 as shown in hidden lines in FIG. 14. The countersunk holes within the hook allow the flat headed fasteners 31 to be threaded directly into the gaff and rigidly secure the gaff 3 to the hook 1. The screws remain hidden below the interior surface of the hook and constitute a part of the insulation means to insulate the leg from the gaff if it were to come into contact with an electrical source.

Figure 15:
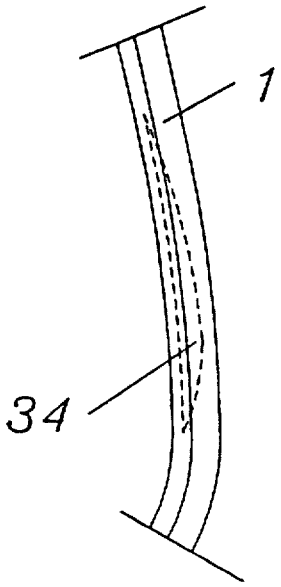
FIG. 15 shows a partial side plan view of the hook of FIG. 2 with one embodiment of a polyurethane foam core.
Figure 16:
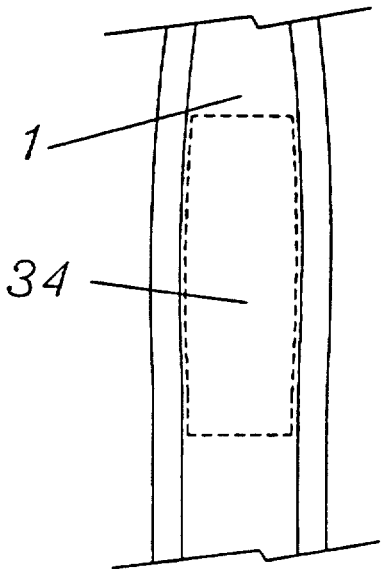
FIG. 16 shows a front plan view of the hook shown in FIG. 15.

FIGS. 15 and 16 show a portion of hook 1 that contains a high density polyurethane foam 34 shown in hidden lines. The foam is used as a filler in the hook. It is placed in the interior of the hook to allow for a consistent and continuous amount of composite material to be used throughout the entire hook 1. The use of foam decreases total part weight, decreases cost, and increases stiffness of the hook 1.

All of the individual parts of the assembly are constructed of non-conductive materials such as high strength composite materials, thermoplastic urethane, polyester, and nylon. The use of such synthetic materials allow the materials to be brightly colored for safety aspects. Such coloring would be inherent within the materials and would not wear off as paint on traditional metal climbers would. The use of synthetic materials also allow for many other advantages for individual parts. For example the use of thermoplastic snap fit buckles are generally easier to use than metal buckles and may be tightened to smaller increments than holes along a leather strap that generally are spaced in one inch increments. The sewing of the supports on the calf pad instead of riveting on traditional pads distributes the stress on the pad more evenly rather than at localized rivet points.

It should be apparent that many modifications could be made to the pole climber assembly which would still be encompassed within the spirit of the present invention. It is intended that all such modifications may fall within the scope of the appended claims.

What is claimed is:

1. A pole climber assembly to facilitate the climbing of vertical poles and trees comprising:

a hook comprising a calf section to be secured about a person's calf and a stirrup section integrally connected to said calf section and at substantially a right angle to said calf section, said stirrup section to hold the person's foot in place within said hook;

a gaff extending outwardly from said hook for engaging and gripping a climb surface;

strap means for strapping the person's foot into said stirrup section and for strapping the person's calf to said calf section;

a non skid pad to protect said hook from structural damage during use resulting from contact with objects external to the pole, said skid pad comprising a horizontal section;

said calf section comprises an interior surface abutting the calf of the person and an exterior surface opposite of said interior surface facing away from the person;

said stirrup section comprises an interior surface abutting the foot of the person and an exterior surface opposite of said interior surface facing away from the person, said horizontal section of said skid pad rigidly attached to said exterior surface of said stirrup section, said skid pad acting as a buffer between said hook and any horizontal surface which may wear against said pole climber assembly;

wherein, said hook is made entirely of a composite material, said composite material including insulation means for insulating the person's calf and foot from any electrical shock resulting from contact of said hook, gaff, or strap means with an electrical source.

2. A pole climber assembly as claimed in claim 1, wherein, said hook is rigidly attached to said gaff by at least one fastener, said insulation means includes at least one countersunk hole molded within said hook, said fastener extending through said countersunk hole and hidden by said hole below the interior surface of said hook, said countersunk hole preventing electrical shock from occurring when said gaff comes into contact with an electrical source.

3. A pole climber assembly as claimed in claim 1, wherein, said non skid pad further comprising a vertical section extending at substantially a right angle to said horizontal section, said vertical section rigidly attached to said exterior surface of said calf section to protect said hook against wear from external objects attached to the pole or person.

4. A pole climber assembly as claimed in claim 1, wherein, said non skid pad further comprises wear indication means for indicating the amount of wear said pole climber assembly has endured.

5. A pole climber assembly as claimed in claim 1, wherein, said non skid pad has an interior surface abutting said exterior surface of said stirrup section, said interior surface of said non skid pad having a mating configuration with said exterior surface of said stirrup section.

6. A pole climber assembly to facilitate the climbing of vertical poles and trees comprising:

a hook comprising a calf section to be secured about a person's calf and a stirrup section integrally connected to said calf section and at substantially a right angle to said calf section, said stirrup section to hold the person's foot in place within said hook, said hook having an internal surface that abuts the person's foot and calf and an external surface that faces away from the foot and calf;

a gaff extending outwardly from said external surface of said hook for engaging and gripping a climb surface;

strap means for strapping the person's foot into said stirrup section and for strapping the person's calf to said calf section;

said hook is made of a composite material, said composite material including means for insulating said external surface of said hook from said internal surface of said hook;

wherein, the person's calf and foot are insulated from any electrical shock resulting from contact of said hook, gaff, or strap means with an electrical source;

an adjustment section for adjusting the longitudinal length of said hook, said adjustment section including positioning means to secure said adjustment section to said calf section in one of a plurality of positions;

said plurality of positions are defined by a plurality of fastener holes through said adjustment section, said fastener holes aligned with at least one fastener hole within said calf section of said hook, said hook further comprising a fastener element extending through said aligned fastener holes within said calf section and adjustment section for clamping said adjustment section to said hook;

said fastener element comprises a bolt connected to a nut;

said nut comprising internal threads and at least two external surfaces, said nut housed within a recess in said calf section, said recess communicating with one end of said fastener hole of said calf section, said recess further comprising at least two surfaces for cooperating with said two surfaces of said nut to prevent the nut from rotating relative to said hook and to hold the nut in place such that said internal threads are in line with said fastener hole;

wherein, said bolt extends through said aligned fastener holes of said adjustment section and calf section and threads into said internal threads of said nut to clamp said adjustment section to said calf section, said insulation means comprising said recess which hides said nut and bolt from the interior surface of said hook thereby helping to prevent electrical shock to the person's leg resulting from contact of said bolt with an electrical source.

7. A pole climber assembly as claimed in claim 6, wherein, said adjustment means further comprises a pair of slots;

said strap means comprises at least one strap having buckle means at opposite ends of said one strap and tightening means for tightening said strap across the person's calf when the calf is positioned against said calf section and said buckle means are engaged, said one strap engaging said pair of slots for securing said strap to said hook;

said strap and buckle means made entirely of non-conductive material to constitute a part of said insulation means to help prevent electrical shock to the person's leg as a result of contact of said strap or buckle means with an electrical source.

8. A pole climber assembly to facilitate the climbing of vertical poles and trees comprising:

a hook comprising a calf section to be secured about a person's calf and a stirrup section integrally connected to said calf section and at substantially a right angle to said calf section, said stirrup section to hold the person's foot in place within said hook, said hook having an internal surface that abuts the person's foot and calf and an external surface that faces away from the foot and calf;

a gaff extending outwardly from said external surface of said hook for engaging and gripping a climb surface;

strap means for strapping the person's foot into said stirrup section and for strapping the person's calf to said calf section;

said hook is made of a composite material, said composite material including means for insulating said external surface of said hook from said internal surface of said hook;

wherein, the person's calf and foot are insulated from any electrical shock resulting from contact of said hook, gaff, or strap means with an electrical source;

a calf pad attached to said calf section for cushioning the calf and holding the calf against said hook, said pad made entirely of non-conductive material and constituting a part of said insulation means for insulating a person's leg from electrical shock resulting from contact of said pad with an electrical source;

a pad attachment section comprising a hook engagement section and a pair of pad attachment appendages, said hook engagement section of a configuration to conform with the cross sectional shape of said calf section of said hook, said calf pad further including means to engage said pad attachment appendages;

means for fastening said calf pad and pad attachement device to said calf section of said hook.

9. A pole climber assembly as claimed in claim 8, wherein, said fastening means comprises at least one strap having buckle means at opposite ends of said one strap and tightening means for tightening said strap across the person's calf when the calf is positioned against said calf section and said buckle means are engaged, said pad attachment section further comprising a pair of slots, said one strap threaded through both slots and around the periphery of said calf section;

said calf section further comprising means to secure said strap to said calf section thereby clamping and securing said pad attachment section to said hook;

said pad attachment section formed entirely from a plastic non-conductive material to allow for said calf appendages to bend and conform to the person's calf, said plastic non-conductive material further constituting a part of said insulation means to help prevent the person's leg from being electrically shocked from contact of said pad attachment section with an electrical source.

10. A pole climber assembly to facilitate the climbing of vertical poles and trees comprising:

a hook comprising a calf section to be secured about a person's calf and a stirrup section integrally connected to said calf section and at substantially a right angle to said calf section, said stirrup section to hold the person's foot in place within said hook, said hook having an internal surface that abuts the person's foot and calf and an external surface that faces away from the foot and calf;

a gaff extending outwardly from said external surface of said hook for engaging and gripping a climb surface;

strap means for strapping the person's foot into said stirrup section and for strapping the person's calf to said calf section;

said hook is made of a composite material, said composite material including means for insulating said external surface of said hook from said internal surface of said hook;

wherein, the person's calf and foot are insulated from any electrical shock resulting from contact of said hook, gaff, or strap means with an electrical source;

an adjustment section for adjusting the longitudinal length of said hook, said adjustment section including a plurality of holes spaced at a predetermined adjustment distance;

said hook further comprising a hole extending from said interior surface to said exterior surface of said hook;

a fastener extending through said hole of said hook and into one of said spaced holes of said adjustment section;

means for insulating said interior surface of said hook from said fastener.

11. A pole climber assembly as claimed in claim 10, wherein, said means for insulating said interior surface of said hook from said fastener comprises a recess for holding a portion of said fastener below said interior surface of said hook.

12. A pole climber assembly as claimed in claim 11, wherein, said recess comprises at least one surface transverse to said interior surface to abut a portion of said fastener, said transverse surface of said recess prevents said fastener from rotating within said hole of said hook.

* * * * *